US007549409B2

(12) United States Patent
Bamba

(10) Patent No.: US 7,549,409 B2
(45) Date of Patent: Jun. 23, 2009

(54) FUEL SUPPLY AMOUNT CONTROL SYSTEM AND BOAT PROPULSION UNIT

(75) Inventor: Takaaki Bamba, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 0 days.

(21) Appl. No.: 12/107,176

(22) Filed: Apr. 22, 2008

(65) Prior Publication Data

US 2008/0262702 A1 Oct. 23, 2008

(30) Foreign Application Priority Data

Apr. 23, 2007 (JP) ..... 2007-112848

(51) Int. Cl.
*F02D 41/30* (2006.01)

(52) U.S. Cl. ..... 123/491; 701/103; 440/84

(58) Field of Classification Search ..... 123/491, 123/492, 478, 480, 486; 701/103–105; 440/84
See application file for complete search history.

(56) References Cited

U.S. PATENT DOCUMENTS 4,459,961 A * 7/1984 Nishimura et al. ..... 123/491
5,575,259 A * 11/1996 Fukui et al. ..... 123/491
6,959,242 B2 10/2005 Katoh et al.

FOREIGN PATENT DOCUMENTS

JP 2007-278129 A * 10/2007

* cited by examiner

*Primary Examiner*—Hieu T Vo
(74) *Attorney, Agent, or Firm*—Keating & Bennett, LLP

(57) ABSTRACT

In a fuel supply amount control system, during a period of engine startup from the time when a crankshaft starts to rotate by a starter motor to the time when the crankshaft stably rotates by fuel combustion, a fuel supply amount is controlled independently before and after a cylinder stroke determination. This enables determination of the fuel supply amount independently before and after the cylinder stroke determination. Accordingly, the required fuel amounts are provided respectively before and after the cylinder stroke determination. As a result, even if the required fuel amounts are different before and after the cylinder stroke determination, engine startup can be achieved in a short time.

7 Claims, 6 Drawing Sheets

FUEL SUPPLY AMOUNT CONTROL SYSTEM AND BOAT PROPULSION UNIT

BACKGROUND OF THE INVENTION

1. Field of the Invention

The present invention relates to a fuel supply amount control system suitably adapted for starting various types of engines such as a V-type, eight-cylinder, four-cycle engine mounted on a boat propulsion unit in an outboard motor or an inboard-outboard motor, and also relates to a boat propulsion unit including the fuel supply amount control system.

2. Description of the Related Art

Conventionally, separate fuel injection patterns are used before and after a cylinder stroke determination (cylinder identification) for improving engine startability when an engine is started.

That is, before the cylinder stroke determination, it is not determined which stroke the cylinder is in among an intake, compression, expansion (combustion), and exhaust stroke. Therefore, fuel is injected into each cylinder at once immediately after crank starting by rotation of a starter motor in order to supply fuel for ignition and combustion. As an example, FIG. 5 shows an engine constructed such that a crank angle is divided into 36 equal portions of 10 degrees each. Each of the first through thirty-fourth portions has a detected tooth and the thirty-fifth and thirty-sixth portions have no tooth. When a crankshaft sensor signal is at portion 7, each injector on the first through eighth cylinders is driven at once to inject fuel.

On the other hand, after the cylinder stroke determination, since it is already determined which stroke the cylinder is in among an intake, compression, expansion (combustion), and exhaust stroke, each cylinder can be injected with fuel at the optimum timing. As such an example, FIG. 6 shows cylinder groups in the above described engine, which are the first and sixth cylinders, the eighth and fifth cylinders, the fourth and seventh cylinders, and the third and second cylinders. Fuel is injected into each group by driving each injector during the compression and exhaust strokes.

Regardless of before or after the cylinder stroke determination, the same arithmetic expression is used to determine the fuel amount during a period from the start of cranking to completing the engine startup (see, for example, paragraphs [0019] and [0020] of JP-A-2004-197700).

However, since which stroke each cylinder is in among an intake, compression, expansion (combustion), and exhaust stroke, is determined by the cylinder stroke determination for the first time, it is considered that the required fuel supply amounts are inherently different between before and after the cylinder stroke determination to achieve engine startup in the shortest time. Nevertheless, since the fuel supply amount (for example, injection pulse width W1 before the cylinder stroke determination shown in FIG. 5 and injection pulse width W2 after the cylinder stroke determination shown in FIG. 6) has been the same before and after the cylinder stroke determination, the fuel supply amount is not always optimum before and after the cylinder stroke determination. Accordingly, engine startup in the shortest time is not achieved.

SUMMARY OF THE INVENTION

In order to overcome the problems described above, preferred embodiments of the present invention provide a fuel supply amount control system and a boat propulsion unit capable of achieving engine startup in the shortest time.

In order to achieve engine startup in the shortest time, a first preferred embodiment of the present invention includes a fuel supply amount control system arranged to control a fuel supply amount during engine startup from the time when a crankshaft starts to rotate by a starter motor to the time when the crankshaft stably rotates by fuel combustion. The fuel supply amount control system preferably includes a fuel control device which controls the fuel supply amount separately before and after the cylinder stroke determination.

A second preferred embodiment of the present invention includes the fuel supply amount control system in accordance with the first preferred embodiment in which the fuel control device changes an arithmetic expression for computing the fuel injection amount before and after the cylinder stroke determination.

A third preferred embodiment of the present invention includes the fuel supply amount control system in accordance with the second preferred embodiment in which the fuel control device changes a base fuel amount used in the arithmetic expression before and after the cylinder stroke determination.

A fourth preferred embodiment of the present invention includes the fuel supply amount control system in accordance with any one of the first to third preferred embodiments in which the fuel control device increases the fuel supply amount before the cylinder stroke determination compared with the fuel supply amount after the cylinder stroke determination.

A fifth preferred embodiment of the present invention includes the fuel supply amount control system in accordance with the fourth preferred embodiment in which the fuel control device controls the fuel to be injected in a single injection into an intake pipe before the cylinder stroke determination.

A sixth preferred embodiment of the present invention includes a boat propulsion unit including the fuel supply amount control system in accordance with any one of the first to fifth preferred embodiments.

According to the first preferred embodiment, the fuel supply amount is determined independently before and after the cylinder stroke determination. Accordingly, the required fuel amounts are provided respectively before and after the cylinder stroke determination. As a result, even if the required fuel amounts are different before and after the cylinder stroke determination, engine startup in the shortest time can be achieved.

According to the second preferred embodiment, the arithmetic expression for computing the fuel injection amount is changed before and after the cylinder stroke determination. Accordingly, the required fuel amounts are provided respectively before and after the cylinder stroke determination. As a result, even if the required fuel amounts are different before and after the cylinder stroke determination, engine startup in the shortest time can be achieved.

According to the third preferred embodiment, the base fuel amount in the arithmetic expression for computing the fuel injection amount is changed before and after the cylinder stroke determination. Accordingly, the fuel supply amount is determined separately before and after the cylinder stroke determination. Therefore, the required fuel amounts are provided respectively before and after the cylinder stroke determination. As a result, even if the required fuel amounts are different before and after the cylinder stroke determination, engine startup in the shortest time can be achieved.

According to the fourth preferred embodiment, an intake valve is opened and the supply of fuel into the cylinder is increased, thereby achieving engine startup in the shortest time. Therefore, the most preferred engine startability can be achieved.

According to the fifth preferred embodiment, fuel is injected more efficiently compared with a case that fuel is separately injected two or more times.

According to the sixth preferred embodiment, the same effects as recited in the first to fifth preferred embodiments can be obtained.

Other features, elements, processes, steps, characteristics and advantages of the present invention will become more apparent from the following detailed description of preferred embodiments of the present invention with reference to the attached drawings.

DETAILED DESCRIPTION OF THE PREFERRED EMBODIMENTS

Description will be hereinafter made of the preferred embodiments of the present invention.

First Preferred Embodiment

Figure 1:
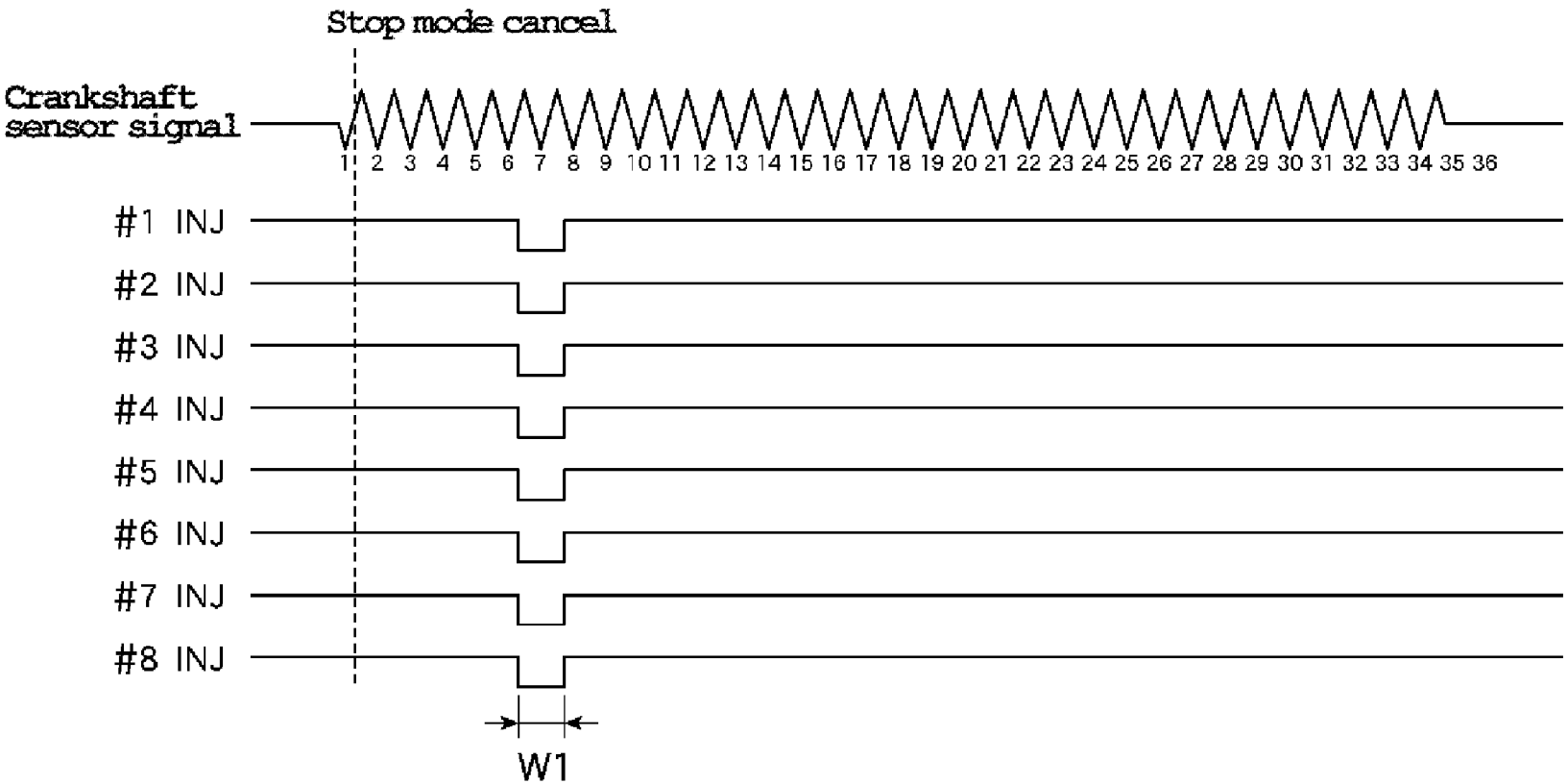
FIG. 1 is a timing chart showing a fuel injection pattern before a cylinder stroke determination (without a cylinder stroke determination) according to a first preferred embodiment of the present invention.

FIGS. 1 though 4 show the first preferred embodiment of the present invention.

Figure 3:
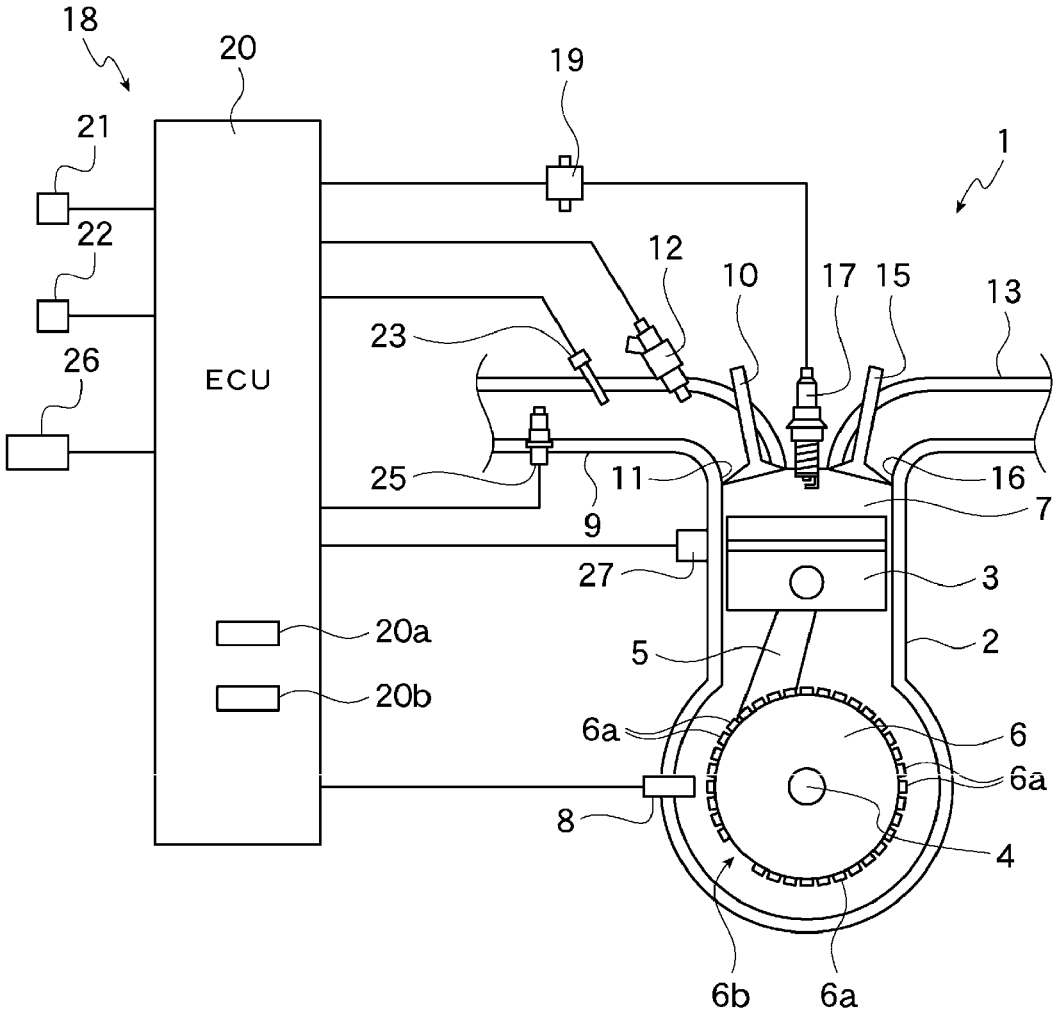
FIG. 3 is a schematic diagram of an engine according to the first preferred embodiment of the present invention.

First, the structure of the present preferred embodiment will be described. A V-type, eight-cylinder, four-cycle engine 1 is mounted in an outboard motor. As shown in FIG. 3, the engine 1 has a cylinder 2, eight of which are alternately arranged in a V-shape in a direction perpendicular to the plane of FIG. 3. On an outer periphery of the cylinder 2, a wall temperature sensor 27 is attached to detect the temperature of the wall of the cylinder 2.

As shown in FIG. 3, a piston 3 is slidably disposed in a horizontal direction (vertical direction in FIG. 3) in each cylinder 2. At one side of the piston 3 (upper side in FIG. 3), a combustion chamber 7 is formed. To the other side of the piston 3 (lower side in FIG. 3), a crankshaft 4 is rotatably connected via a connecting rod 5. A disk-shaped toothed detection rotor 6 is concentrically fixed about the crankshaft 4. The detection rotor 6 is divided into 36 equal portions corresponding to each 10 degrees of the crank angle. Each of the first through thirty-fourth portions has a tooth 6*a*, and each of the thirty-fifth and thirty-sixth portions has a missing tooth 6*b*. A crankshaft sensor 8 is disposed in the vicinity of the detection rotor 6 to detect the teeth 6*a* and the missing teeth 6*b*.

In addition, as shown in FIG. 3, an intake pipe 9 is connected to the combustion chamber 7 in the cylinder 2. In the intake pipe 9, an intake valve 10 is provided to open and close an intake port 11, and an injector 12 is provided to inject fuel into the intake pipe 9. Further, in the intake pipe 9, an intake pressure sensor 23 is provided to detect an intake pressure, and an intake temperature sensor 25 is provided to detect an intake temperature.

As shown in FIG. 3, an exhaust pipe 13 is in communication with and connected to the combustion chamber 7. In the exhaust pipe 13, an exhaust valve 15 is provided to open and close an exhaust port 16. In addition, an ignition plug 17 is attached to generate a spark in the combustion chamber 7. An ignition coil 19 is connected to the ignition plug 17.

As shown in FIG. 3, a fuel supply amount control system 18 is provided with the engine 1. The fuel supply amount control system 18 includes an ECU (Engine Control Unit) 20. The ECU 20 is connected to an ignition key 21, a starter motor 22, an atmospheric pressure sensor 26 for detecting an atmospheric pressure, the ignition coil 19, the injector 12, the intake pressure sensor 23, the intake temperature sensor 25, the wall temperature sensor 27, and the crankshaft sensor 8. The ECU 20 includes a cylinder determining section 20*a* and a fuel control section (fuel control device) 20*b*.

The function of the fuel supply amount control system 18 will now be described.

Figure 4:
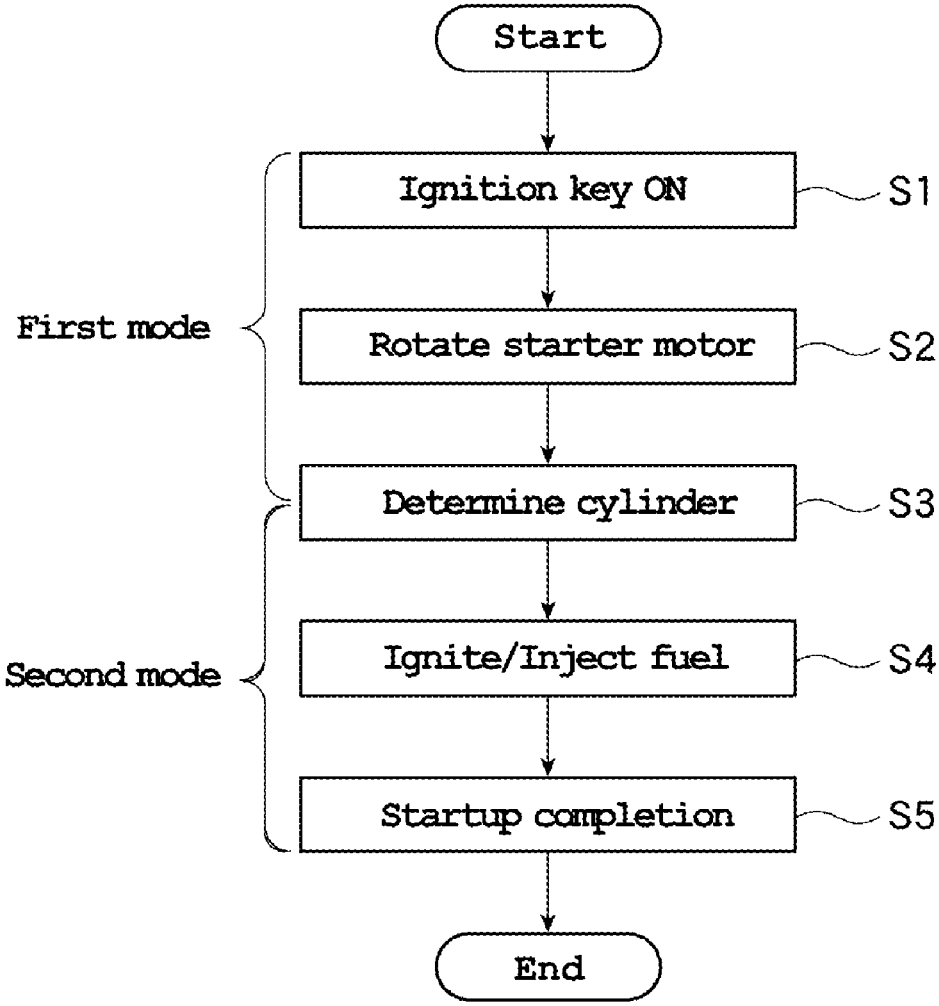
FIG. 4 is a flow chart showing an engine startup operation according to the first preferred embodiment of the present invention.
Figure 5:
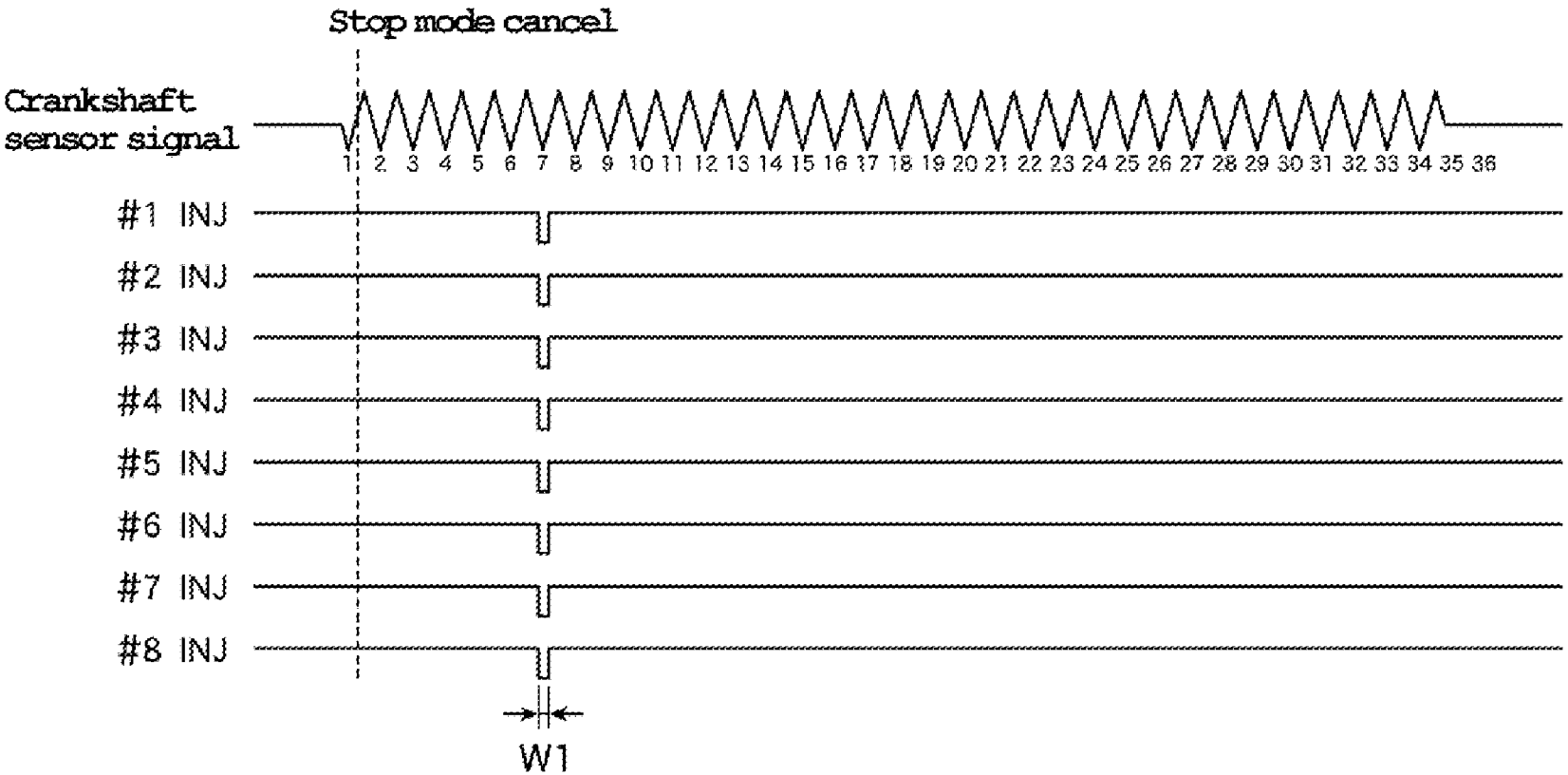
FIG. 5 Prior Art
FIG. 5 is a timing chart showing the fuel injection pattern before the cylinder stroke determination (without the cylinder stroke determination) in a conventional fuel supply amount control method.
Figure 6:
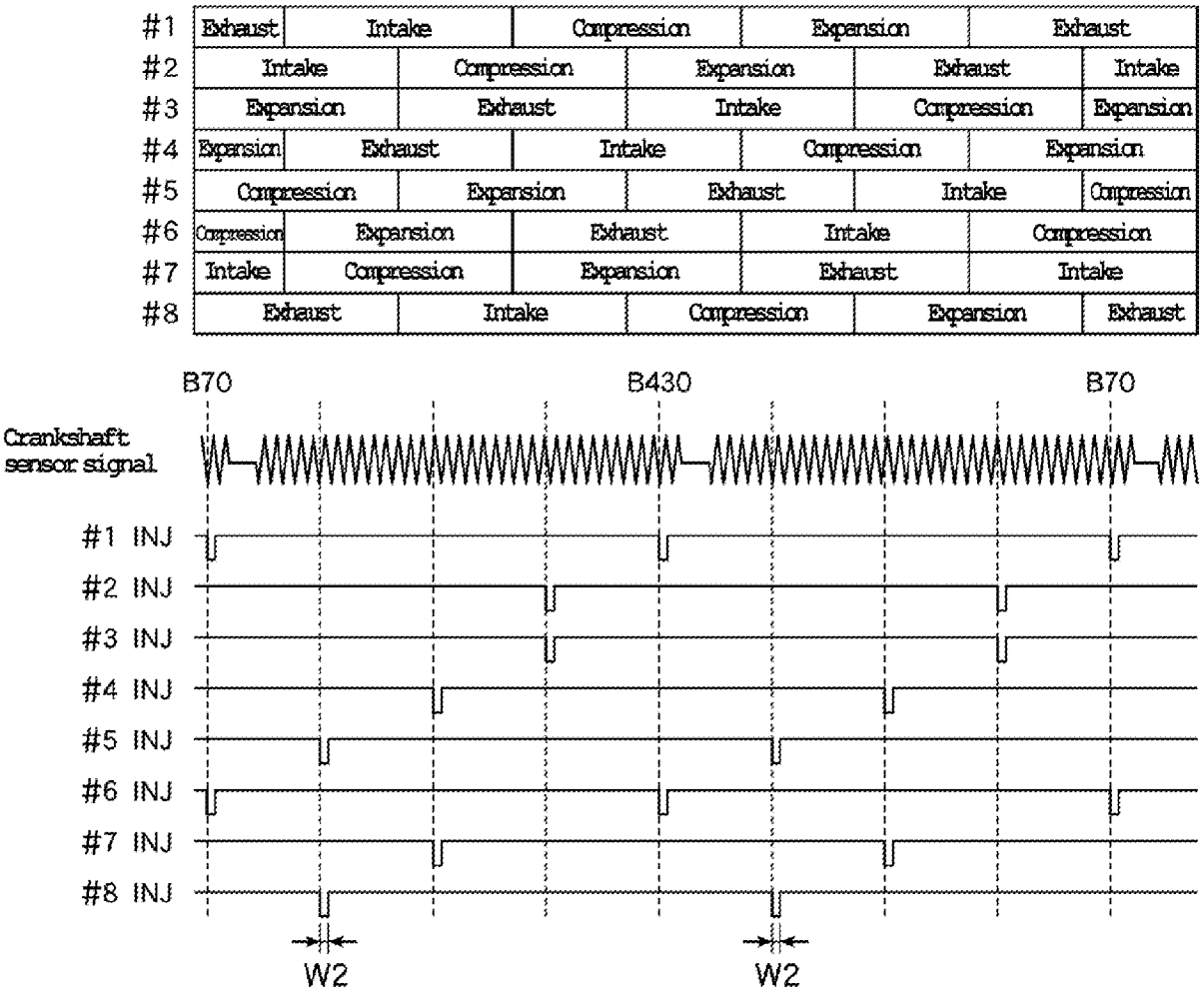
FIG. 6 Prior Art
FIG. 6 is a timing chart showing the fuel injection pattern after the cylinder stroke determination in the conventional fuel supply amount control method.

The engine 1 with the above construction starts up in accordance with the procedure shown in FIG. 4.

First, a person who starts up the engine 1 (hereinafter referred to as a boat operator) turns the ignition key 21 ON (Step S1).

Next, the starter motor 22 rotates (Step S2). Then, the crankshaft 4 starts to rotate as the starter motor 22 rotates. Accordingly, the detection rotor 6 starts to rotate in synchronization with the crankshaft 4.

The ECU 20 then executes a cylinder stroke determination (Step S3). That is, the ECU 20 detects the missing teeth 6*b* of the detection rotor 6 by a signal outputted from the crankshaft sensor 8. Based on the above detection, the ECU 20 recognizes the ignition timing of each cylinder and determines in which stroke each cylinder is in among an intake, compression, expansion, and exhaust stroke.

Next, the ECU 20 drives the ignition coil 19 to cause the ignition plug 17 to ignite in the expansion (combustion) stroke and drives the injector 12 to inject fuel into the intake pipe 9 in the middle of the compression stroke and in the middle of the exhaust stroke (Step S4). During this time, the ECU 20 recognizes the ignition timing of each cylinder by the cylinder stroke determination, and therefore ignition of the ignition plug 17 can be smoothly executed. Also, the ECU 20 recognizes where each cylinder is in the intake, compression, expansion, or exhaust stroke by the cylinder stroke determination. Therefore, fuel injection can be smoothly executed. As a result, the crankshaft 4 stably rotates at a predetermined rotational speed (for example, 500 to 600 rpm) by fuel combustion even after rotation of the stator motor 22 is stopped.

At this point, startup of the engine 1 is completed (Step S5).

When the engine 1 is started, or during the engine startup, fuel is injected into the intake pipe 9 in different amounts before and after the cylinder stroke determination (Step S3) as described below.

That is, the cylinder determining section 20*a* of the ECU 20 divides an engine startup timing into two modes that are before the cylinder stroke determination (Step 1 through Step 3 in FIG. 4) and after the cylinder stroke determination (Step 3 through Step 5 in FIG. 4). The mode before the cylinder stroke determination is referred to as a first mode, and the mode after the cylinder stroke determination is referred to as a second mode.

In the first mode (before the cylinder stroke determination), the fuel control section 20*b* of the ECU 20 causes a large amount of fuel to be injected into the intake pipe 9 in a single injection. In order to do so, the driving time of the injector 12 is increased to widen an injection pulse width W1 before the cylinder stroke determination, as shown in FIG. 1. Specifically, an injector driving time T1 is computed from an arithmetic expression shown in Equation 1. The injector 12 is driven to inject fuel for the injector driving time T1. At this point, the injector driving time T1 is computed by adding a dead time T3 (T3>0) as shown in Equation 1. Therefore, regardless of the delayed response of the injector 12, the problem that the injector driving time T1 substantially becomes negative can be avoided. Meanwhile, in the computation of the injector driving time T1, it is possible to set the upper limit (for example, 60 ms) to maintain the durability of the injector 12 and set the injector driving time T1 within the upper limit.

$$T1=F1\times K1\times K2\times K3\times K4+T3 \qquad \text{Arithmetic expression 1}$$

T1: injector driving time

F1: base fuel amount without cylinder stroke determination (base fuel amount before cylinder stroke determination)

K1: intake pressure correction factor for startup base fuel amount

K2: intake temperature correction factor

K3: startup atmospheric pressure correction factor

K4: injection amount driving time conversion factor

T3: dead time (time corresponding to delayed response of injector)

At this point, the base fuel amount without the cylinder stroke determination F1 may be adjusted according to the vaporized fuel state in the cylinder. In order to do so, the temperature of the wall of the cylinder 2 is measured by the wall temperature sensor 27 to determine whether or not the temperature of the wall is equal to or higher than a predetermined temperature. When, as a result, the temperature of the wall is equal to or higher than the predetermined temperature, fuel vaporization in the cylinder is considered to be accelerative. Accordingly, the base fuel amount without the cylinder stroke determination F1 is set to be small. On the other hand, when the temperature of the wall is lower than the predetermined temperature, fuel vaporization in the cylinder is considered to be not so accelerative. Accordingly, the base fuel amount without the cylinder stroke determination F1 is set to be large.

Figure 2:
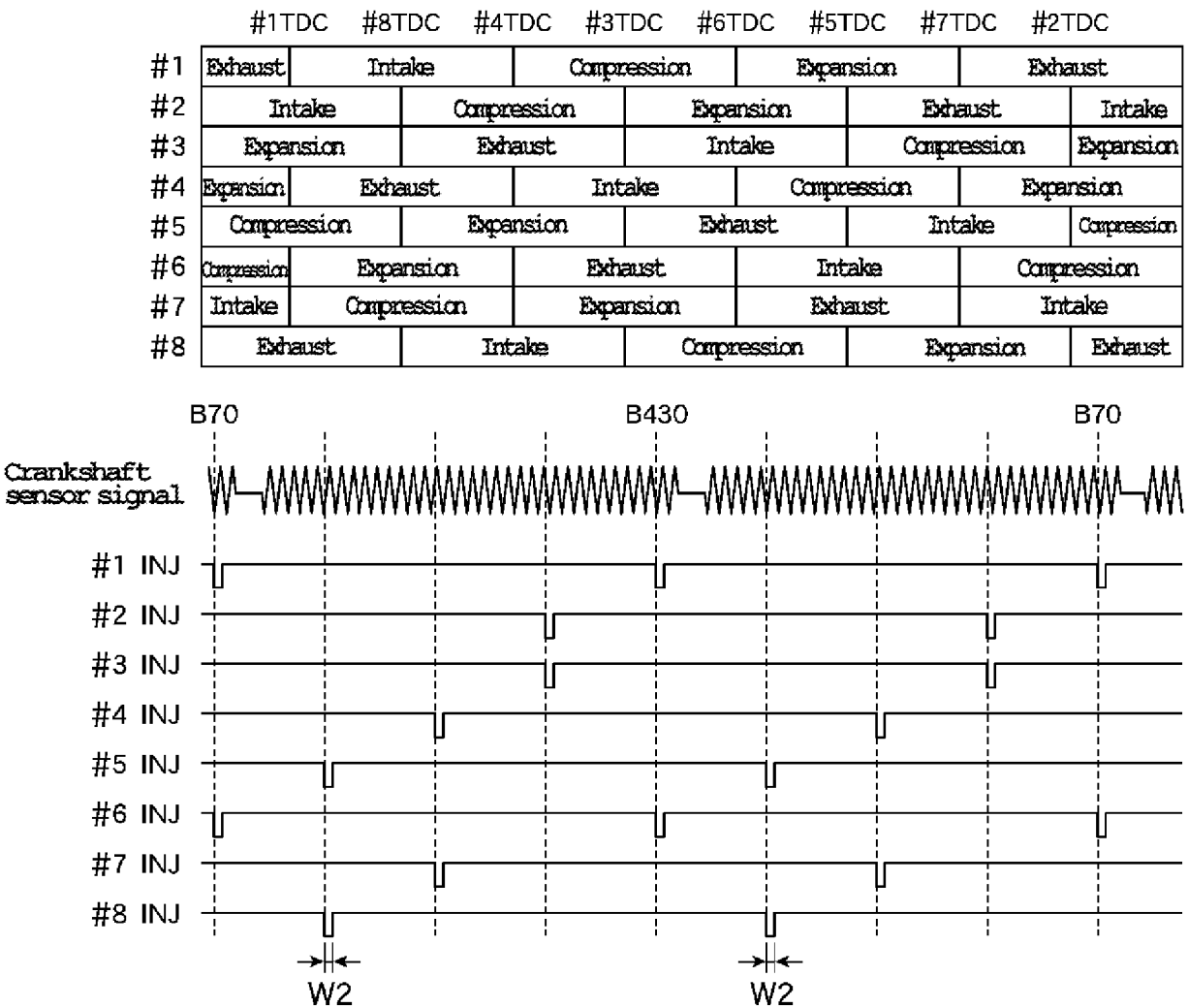
FIG. 2 is a timing chart showing the fuel injection pattern after the cylinder stroke determination according to the first preferred embodiment of the present invention.

In the second mode (after the cylinder stroke determination), the fuel control section 20*b* of the ECU 20 causes a little amount of fuel to be injected into the intake pipe 9 in a single injection. In order to do so, by using a different arithmetic expression from that used before the cylinder stroke determination, the driving time of the injector 12 is decreased to narrow an injection pulse width W2 after the cylinder stroke determination compared with the injection pulse width W1 before the cylinder stroke determination, as shown in FIG. 2. Specifically, an injector driving time T2 is computed from an arithmetic expression shown in Equation 2. The injector 12 is driven to inject fuel for the injector driving time T2. At this point, the injector driving time T2 is computed by adding the dead time T3 (T3>0) as shown in Equation 2. Therefore, regardless of the delayed response of the injector 12, the problem that the injector driving time T2 substantially becomes negative can be avoided. Meanwhile, in the computation of the injector driving time T2, it is possible to set the upper limit (for example, 60 ms) for performance of the injector 12 (reliability, durability, etc.) and set the injector driving time T2 within the upper limit.

$$T2=F2\times K1\times K2\times K3\times K4+T3 \qquad \text{Arithmetic expression 2}$$

T2: injector driving time

F2: startup base fuel amount (base fuel amount after cylinder stroke determination)

K1: intake pressure correction factor for startup base fuel amount

K2: intake temperature correction factor

K3: startup atmospheric pressure correction factor

K4: injection amount driving time conversion factor

T3: dead time (time corresponding to delayed response of injector)

At this point, the startup base fuel amount F2 may be adjusted according to the vaporized fuel state in the cylinder. In order to do so, the temperature of the wall of the cylinder 2 is measured by the wall temperature sensor 27 to determine whether or not the temperature of the wall is equal to or higher than a predetermined temperature. When, as a result, the temperature of the wall is equal to or higher than the predetermined temperature, fuel vaporization in the cylinder is considered to be accelerative. Accordingly, the startup base fuel amount F2 is set to be small. On the other hand, when the temperature of the wall is lower than the predetermined temperature, fuel vaporization in the cylinder is considered to be not so accelerative. Accordingly, the startup base fuel amount F2 is set to be large.

The base fuel amount without the cylinder stroke determination F1 shown in Equation 1 is larger than the startup base fuel amount F2 shown in Equation 2. Other factors (intake pressure correction factor for the startup base fuel amount K1, intake temperature correction factor K2, startup atmospheric pressure correction factor K3, injection amount driving time conversion factor K4, dead time T3) are common to Equation 1 and Equation 2. Therefore, the injector driving time T1 is longer than the injector driving time T2, and the ratio T1/T2 is equal to the ratio F1/F2 or the ratio between the base fuel amount without the cylinder stroke determination F1 and the startup base fuel amount F2. If T1/T2 is, for example 5, F1/F2 equals 5.

Thus, increasing the fuel supply amount before the cylinder stroke determination compared with the fuel supply amount after the cylinder stroke determination causes the intake valve 10 to open and increases the probability of supplying fuel into the cylinder 2, thereby achieving engine startup in the shortest time.

Since fuel is injected into the intake pipe 9 in a single injection before the cylinder stroke determination, fuel is injected more efficiently compared with a case that fuel is separately injected two or more times.

Other Preferred Embodiments

In the first preferred embodiment described above, the fuel injection amount is appropriately controlled preferably by adjusting the injector driving time T1. However, it is also possible to control the fuel injection amount by adjusting a physical quantity other than the injector driving time T1 or by directly controlling the fuel injection amount.

In the first preferred embodiment described above, the fuel injection amount before the cylinder stroke determination is preferably more than the fuel injection amount after the cylinder stroke determination. However, conversely, the fuel injection amount after the cylinder stroke determination may be more than the fuel injection amount before the cylinder stroke determination depending on the intake pressure, intake temperature, atmospheric pressure, or other conditions. In other words, it is essential to control the fuel injection amount independently before and after the cylinder stroke determination. This enables to determine the fuel supply amount independently before and after the cylinder stroke determination. Accordingly, the required fuel amounts are provided respectively before and after the cylinder stroke determination. As a result, even if the required fuel amounts are different before and after the cylinder stroke determination, engine startup in the shortest time can be achieved.

Further, in the first preferred embodiment described above, different arithmetic expressions are used before and after the cylinder stroke determination to determine the fuel injection amount so as to optimize the fuel injection amount respectively before and after the cylinder stroke determination. However, the timing which changes the arithmetic expression for the fuel injection amount is not limited to the time of the cylinder stroke determination. A timing other than the cylinder stroke determination may be applied.

In the first preferred embodiment described above, the engine startup timing is divided into two modes and the fuel injection amount is controlled independently in each mode in order to achieve the most preferred engine startability. However, it is also possible to divide the engine startup timing into three modes and control the fuel injection amount independently in each mode. In this case, the fuel supply amount during engine startup is determined independently in each mode, and therefore, the required fuel amount in each mode can be respectively supplied. As a result, even if the required fuel amount is different in each mode, engine startup in the shortest time can be achieved.

In the first preferred embodiment described above, the teeth 6*a* and the missing teeth 6*b* are preferably arranged on the periphery of the detection rotor 6. However, the teeth 6*a* and the missing teeth 6*b* may be arranged on a flywheel (not shown) attached to the crankshaft 4.

In the first preferred embodiment described above, the engine 1 including a fuel supply method in which fuel is injected into the intake pipe 9 is disclosed. However, the present invention may be used in the engine 1 including another fuel supply method (for example, a fuel supply method in which fuel is injected directly into the cylinder 2, a fuel supply method using a carburetor, etc.)

In the first preferred embodiment described above, the engine 1 is mounted in an outboard motor. However, the present invention may be used in an engine mounted in another boat propulsion unit (for example, an inboard-outboard motor).

In the first preferred embodiment described above, the engine 1 is of a V-type, eight-cylinder, four-cycle type. However, the type of the engine 1 (the number of cylinders or the cylinder arrangement) is not limited thereto. The present invention may be applied to, for example, an in-line, four-cylinder, four-cycle engine or a single-cylinder, two-cycle engine.

The present invention can be widely applied to various boat propulsion units such as an outboard motor and an inboard-outboard motor.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A fuel supply amount control system for controlling a fuel supply amount during engine startup, comprising:

a fuel control device arranged to control the fuel supply amount independently during the engine startup before and after a cylinder stroke determination; wherein the engine startup corresponds to a time when a crankshaft starts to rotate to a time when the crankshaft stably rotates by fuel combustion; and the cylinder stroke determination corresponds to a time when the stroke of a cylinder is determined to be one of an intake, compression, expansion, or exhaust stroke.

2. The fuel supply amount control system according to claim 1, wherein the fuel control device is arranged to change an arithmetic expression used to compute the fuel supply amount before the cylinder stroke determination, compared to after the cylinder stroke determination.

3. The fuel supply amount control system according to claim 2, wherein the fuel control device changes a base fuel amount used in the arithmetic expression before the cylinder stroke determination, compared to after the cylinder stroke determination.

4. The fuel supply amount control system according to claim 1, wherein the fuel control device increases the fuel supply amount before the cylinder stroke determination compared with the fuel supply amount after the cylinder stroke determination.

5. The fuel supply amount control system according to claim 4, wherein the fuel control device changes the fuel supply amount injected at a single time into an intake pipe before the cylinder stroke determination.

6. The fuel supply amount control system according to claim 4, wherein the fuel control device changes the driving time of the fuel supply amount injected at a single time into the intake pipe before the cylinder stroke determination.

7. A boat propulsion unit comprising the fuel supply amount control system according to claim 1.

* * * * *